United States Patent [19]

Rhodes

[11] 4,452,369

[45] Jun. 5, 1984

[54] HOLDER FOR AN INSULATED CONTAINER OF BEVERAGE

[76] Inventor: Christopher Rhodes, Rte. 1, Box 311, Oak Dr., O'Fallon, Mo. 63366

[21] Appl. No.: 450,300

[22] Filed: Dec. 16, 1982

[51] Int. Cl.[3] ..... B65D 8/04; B65D 55/16

[52] U.S. Cl. ..... 220/85 H; 215/100.5; 220/400; 220/411

[58] Field of Search ..... 215/295, 100.5, 12 R; 294/27 H, 32; 220/306, 85 H, 411, 412, 413, 212, 68, 400; D7/70

[56] References Cited

U.S. PATENT DOCUMENTS

| | | | |
|---|---|---|---|
| 2,532,244 | 11/1950 | Pasmore | D7/70 X |
| 2,784,578 | 3/1957 | Southwick | 220/85 H |
| 2,813,742 | 11/1957 | Neugebauer | 220/85 H |
| 3,013,691 | 12/1961 | Prentice | 220/85 |
| 3,074,678 | 1/1963 | Mele | 248/145.6 |
| 3,107,028 | 10/1963 | De Robertis | 220/85 H |
| 3,135,418 | 6/1964 | Tracy | 220/68 X |
| 3,353,729 | 11/1967 | Hull | 224/45 |
| 3,458,164 | 7/1969 | Massey | 248/145.6 |
| 3,598,271 | 8/1971 | Holley | 215/100.5 X |
| 3,610,671 | 10/1971 | Conger | 294/27.1 X |
| 4,040,538 | 8/1977 | Gerson | 220/212 X |
| 4,282,279 | 8/1981 | Stickland | 428/101 |
| 4,389,802 | 6/1983 | McLaren et al. | 220/306 X |

*Primary Examiner*—Allan N. Shoap
*Assistant Examiner*—Robert Petrik
*Attorney, Agent, or Firm*—Senniger, Powers, Leavitt and Roedel

[57] ABSTRACT

A holder for an insulated container of beverage. The holder has a base and a handle extending up from the base at the periphery of the base. The insulator and container are secured on the base by inserting the insulator into a vertical opening in the handle of the holder.

16 Claims, 6 Drawing Figures

FIG. 2
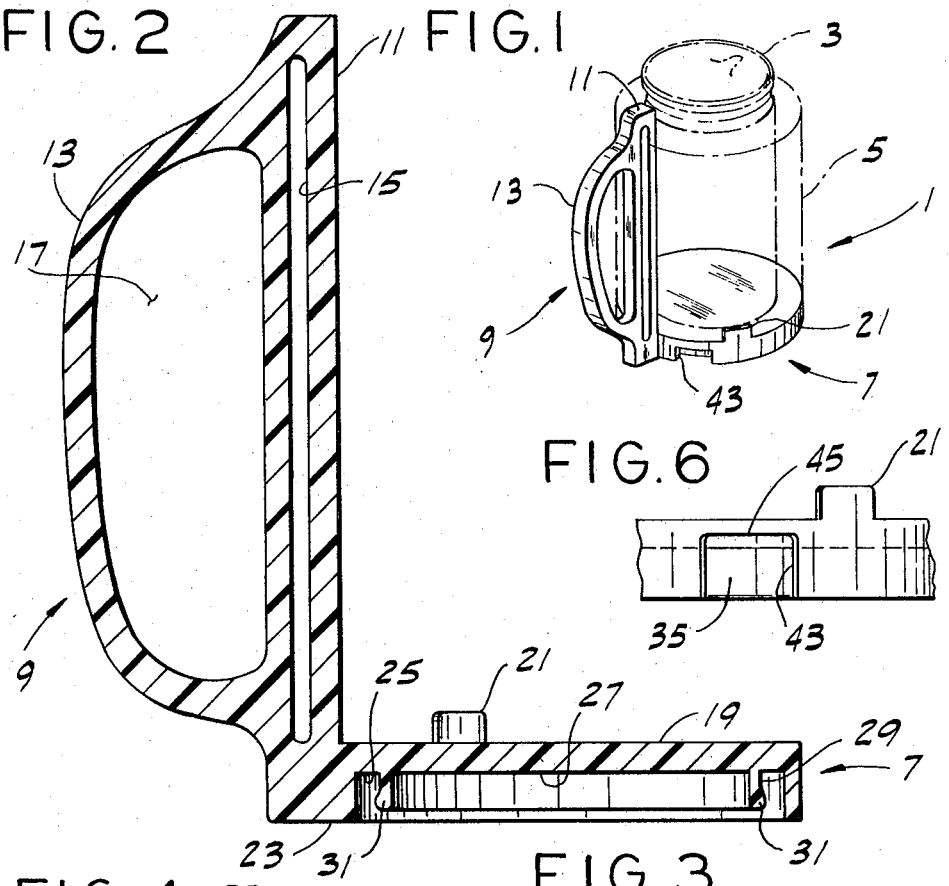
FIG. 1
FIG. 6
FIG. 4
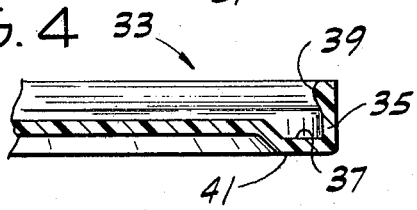
FIG. 3
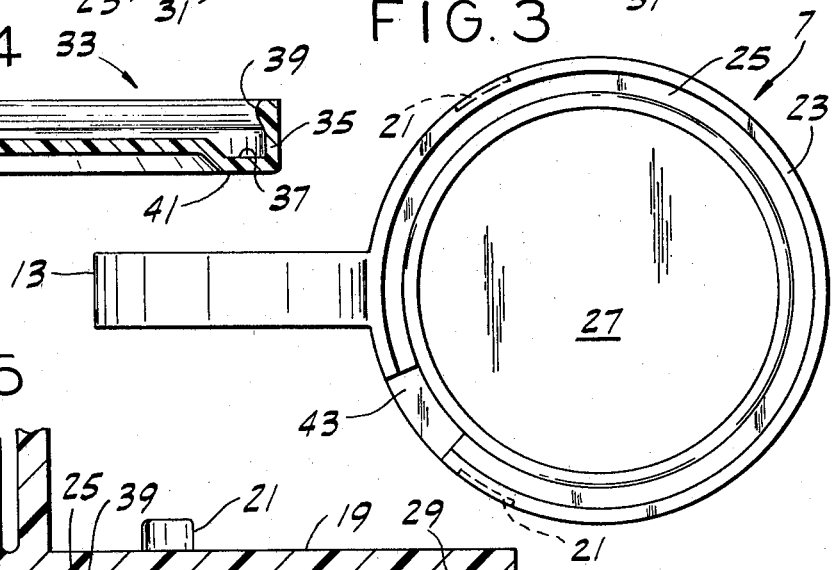
FIG. 5
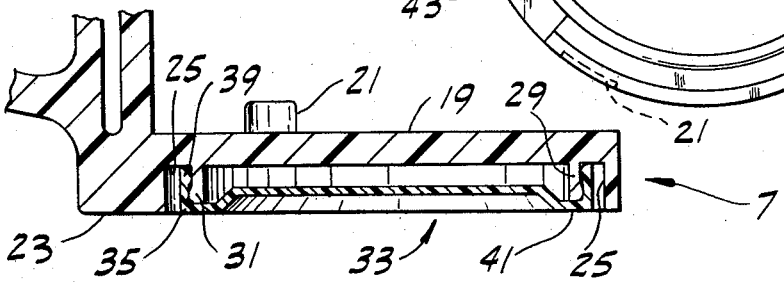

HOLDER FOR AN INSULATED CONTAINER OF BEVERAGE

BACKGROUND OF THE INVENTION

This invention relates generally to a holder for a container of beverage and, more particularly, to a holder for a cylindric container of beverage in a thermal insulator.

The holder of this invention is especially suited for use with wraparound insulators of the type shown in U.S. Pat. No. 4,282,279. Reference may be made to U.S. Pat. Nos. 3,013,691, 3,074,678, 3,353,729 and 3,458,164 for other holders generally in the field of this invention.

SUMMARY OF THE INVENTION

Among the several objects of the invention may be noted the provision of an improved holder for a container of beverage in an open-top insulator; the provision of such a holder which securely holds the insulator and container therein and allows the user to drink directly from the container while grasping a handle; the provision of such a holder which incorporates a lid that fits on the top of the container to prevent inadvertent spilling of the contents of the container when it is open; and the provision of such a holder which is relatively simple in construction for economical manufacture.

In general, this invention involves a holder for a cylindric container of beverage in an open-top insulator. The holder comprises a base for supporting the insulated container in an upright position and handle means extending up from the base at the periphery of the base. This handle means has an elongate generally vertical opening therein for receiving a vertical wall portion of the insulator thereby to secure the insulator and container therein on the base.

Other objects and features will be in part apparent and in part pointed out hereinafter.

BRIEF DESCRIPTION OF THE DRAWINGS

FIG. 1 is a perspective view of a holder of the present invention holding an insulated can (shown in phantom);

FIG. 2 is an enlarged vertical section of the holder shown in FIG. 1;

FIG. 3 is a bottom plan of the holder;

FIG. 4 is a partial cross section of the lid;

FIG. 5 is a portion of FIG. 2 showing the lid in place on the holder; and

FIG. 6 is an enlarged partial elevation showing a finger opening in the base of the holder.

Corresponding reference characters indicate corresponding parts throughout the several views of the drawings.

DESCRIPTION OF THE PREFERRED EMBODIMENT

Referring now to FIG. 1 of the drawings, a holder of this invention, designated in its entirety by the reference numeral 1, is shown holding a cylindric container 3 of beverage (e.g., a can of softdrink or beer) in an open-top insulator 5. As illustrated, the insulator is of the type generally described in U.S. Pat. No. 4,282,279, comprising a flexible insulator strip which is designed to be wrapped around the container with its ends releasably fastened in overlapping relation.

More specifically, the holder comprises a circular base 7 for supporting the insulated container 3 in an upright position, and handle means 9 extending up from the base at its periphery. The base 7 and handle means 9 are preferably integrably molded from a suitable synthetic resin material. Handle means 9 includes an inner rib 11 and an outer rib 13. The inner handle member 11 extends vertically upwardly from the base 7 a distance corresponding generally to the height of the container 3 for which the holder 1 is designed to be used. It has a vertical slot 15 therein of sufficient of sufficient width and height to receive therethrough a vertical wall portion of insulator 5. The fit of the insulator 3 in the slot 15 should be reasonably snug. The outer handle member 13 is bowed outwardly away from the inner handle member 11 and is joined at its upper and lower ends to the inner handle member forming hand opening 17 through which a hand may be inserted to grasp the outer handle member 13 to pick up the holder 1.

The circular base 7 of the holder has a diameter somewhat greater than that of container 5 and has a flat upper surface 19 for stably supporting the insulated container thereon. A pair of tabs 21 projecting upwardly from the base are engageable by the insulated container and constitute means for substantially preventing slippage of the container on the base. For reasons which will appear hereinafter, the bottom 23 of the base 7 has a circular peripheral groove 25 therein, the diameter of which is only slightly greater than that of container 5. The central portion of the bottom 23 of the base 7 is upwardly recessed, as indicated at 27, resulting in the formation of a downwardly-depending annular flange 29 spaced inwardly from the outer periphery of the base. This flange and the outer periphery of the base define the sides of groove 25. A bead 31 projects outwardly from the flange 29 at its lower (free) end.

In accordance with this invention, the holder includes a lid 33 for covering the top of the container 5 when it is opened. The lid 33 is generally circular, made of a resilient material and is designed to fit over the top of the container after it is opened. This feature of the invention enables the user to avoid inadvertently spilling the contents of the container 5 when his attention is directed elsewhere, as when he is driving in a car. The lid 33 may also be used to cover the contents of the container and store it for later consumption. As shown best in FIG. 4, the lid 33 has a flange 35 at its periphery and a groove 37 in its bottom adapted to receive the rim of container 5 when the lid is placed on the container. The flange 35 has a lip 39 which extends inwardly from the flange at its outer (free) end. When the lid is placed on the top of a can, this lip is engageable with the rim of the can for holding the lid on the can.

As illustrated in FIG. 5, the lid 33 may be secured to the base 7 by inverting it and inserting flange 35 into the groove 25 in the bottom of the base. When this is done, the inwardly-projecting lip 39 on the flange 35 snaps over the outwardly-projecting bead 31 on the flange 29 of the base 7, lip 39 and bead 31 thus constituting means for snap-fastening the lid flange 35 in groove 25 to secure the lid 33 to the base 7 of the holder 1. When the lid 33 is secured to the base 7, the top portion 41 of the lid 33 is generally flush with the outer periphery of the bottom 23 of the base 7 to provide a level platform on which to set the holder 1.

To facilitate removal of the lid 33 from groove 25, a portion of the outer periphery of the base is removed to provide a finger opening 43 (FIG. 6), the top 45 of which extends above the bottom of groove 25 and the flange 35 of the lid 33 therein. This allows the user to easily unsnap the lid 33 from the bottom 23 of the base.

To use the holder 1, one end of a wraparound type insulator strip 5 is inserted through the slot 15 in the inner handle member 11 and pulled approximately halfway therethrough. A container 3 is then placed inside the tabs 21 on the base 7 and the ends of the insulator strip are releasably fastened in overlapping relation. The container 3 and insulator 5 are thereby secured to the holder 1. Once the container 3 is opened and the user wishes to keep the contents from inadvertently spilling out, the lid 33 may be unsnapped from the base 7 by inserting a finger into opening 43 and pressing down on the flange 35 of the lid 33 to remove it from groove 25. The lid may then be placed on top of the container. To drink the remaining contents of the container, the lid 33 may be removed from the top of the container and snapped back into the groove in the bottom of the base.

While a holder of this invention is particularly suited for use with wraparound-type insulators, it will be understood that it is not limited to such insulators.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A holder for a cylindric container of beverage in an insulator strip, said insulator strip being adapted to be wrapped around said container and its ends fastened, said holder comprising a base for supporting the insulated container in an upright position, and handle means comprising inner and outer handle members extending upwardly from the base at its periphery, the outer handle member being spaced from the inner handle member to provide a hand opening, said inner handle member having a vertical slot therein through which one end of said insulator strip may be inserted and the strip then wrapped around the container for securing the insulator and container therein on the base.

2. A holder as set forth in claim 1 adapted for use with an insulator of the type comprising an insulator strip adapted to be wrapped around a container with its ends releasably fastened in overlapping relation, said vertical slot being a closed slot, one end of said strip being adapted to be inserted through said slot and the strip then wrapped around the container on the base.

3. A holder as set forth in claim 1 further comprising means on the base engageable by said insulated container for substantially preventing slippage of the insulated container on the base.

4. A holder as set forth in claim 1 further comprising a lid for said container securable to the base.

5. A holder as set forth in claim 4 wherein said lid has a flange at its periphery and said base has a peripheral groove in its bottom for receiving the flange.

6. A holder as set forth in claim 5 further comprising means for securing the flange in the groove.

7. A holder as set forth in claim 6 wherein said lid is of resilient material and said securing means comprises interengageable snap-fastening means on the flange and on the base for snap-fastening the lid to the base.

8. A holder as set forth in claim 7 wherein said snap-fastening means comprises a lip projecting inwardly from the flange, and a bead projecting outwardly from the base into said groove, the lip on the flange being adapted to snap over said bead when the lid is inserted into the groove thereby to snap-fasten the lid to the base.

9. A holder as set forth in claim 8 wherein the outer periphery of the base has a finger opening therein providing access to the lid in the groove for disengaging said lip from said bead to remove the lid from the base.

10. A holder as set forth in claim 9 wherein said lid and groove are generally circular in shape, the central portion of the bottom of the base being upwardly recessed to form a downwardly-depending circular flange spaced from the outer periphery of the base to define said groove in the base, said flange having said outwardly-projecting bead thereon.

11. A holder for a cylindric container of beverage in an insulator strip, said insulator strip being adapted to be wrapped around a container and its ends releasably fastened in overlapping relation, said holder comprising a base for supporting the insulated container in an upright position and handle means extending up from the base at the periphery of the base, said handle means having an elongate generally vertical opening therein through which one end of said insulator strip may be inserted and the strip then wrapped around the container for securing the insulator and container therein on the base, and a lid of resilient material for said container securable to the base, said lid having a flange at its periphery and said base having a groove therein for receiving the flange.

12. A holder as set forth in claim 11 wherein said handle means comprises inner and outer handle members extending upwardly from the base at its periphery, the outer rib being spaced from the inner rib to provide a hand opening.

13. A holder as set forth in claim 12 wherein said inner handle member has a vertical slot therein constituting said vertical opening.

14. A holder as set forth in claim 11 further comprising means on the base engageable by said insulated container for substantially preventing slippage of the insulated container on the base.

15. A holder as set forth in claim 11 further comprising means for snap-fastening the flange in the groove thereby to secure the lid to the base.

16. A holder as set forth in claim 15 wherein said snap-fastening means comprises a lip projecting inwardly from the flange, and a bead projecting outwardly from the base into said groove, the lip on the flange being adapted to snap over said bead when the lid is inserted into the groove thereby to snap-fasten the lid to the base.

* * * * *